US006381758B1

(12) United States Patent
Roberts, II et al.

(10) Patent No.: US 6,381,758 B1
(45) Date of Patent: May 7, 2002

(54) HEAD RESTRAINT SYSTEM FOR RACECAR DRIVERS

(75) Inventors: Lyman J. Roberts, II, Gallatin; Asif A. Lala, Nashville, both of TN (US); Panasarn Aim Jirut, Chicago, IL (US)

(73) Assignee: Vanderbilt University, Nashville, TN (US)

( * ) Notice: Subject to any disclaimer, the term of this patent is extended or adjusted under 35 U.S.C. 154(b) by 0 days.

(21) Appl. No.: 09/932,837

(22) Filed: Aug. 17, 2001

Related U.S. Application Data

(60) Provisional application No. 60/270,713, filed on Feb. 22, 2001.

(51) Int. Cl.[7] ..... A42B 7/00; A63B 71/10

(52) U.S. Cl. ..... 2/421; 2/425; 2/468

(58) Field of Search ..... 2/421, 411, 468, 2/425, 416, 6.2; 280/290, 748, 801.1; 297/465, 464, 393, 216.12; 244/122 AG

(56) References Cited

U.S. PATENT DOCUMENTS 4,664,341 A * 5/1987 Cummings 4,967,985 A * 11/1990 Deakin

FOREIGN PATENT DOCUMENTS

| | | | |
|---|---|---|---|
| DE | 4445219 | * | 6/1993 |
| DE | 19540574 | * | 4/1997 |
| JP | 6-156185 | * | 6/1984 |

* cited by examiner

*Primary Examiner*—Rodney M. Lindsey
(74) *Attorney, Agent, or Firm*—Waddey & Patterson; Lucien Wayne Beavers

(57) ABSTRACT

A head restraint system is provided for a driver of a racecar. The system includes a helmet for receiving the driver's head, and first and second energy dissipating extendable restraining lanyards for connecting the helmet to a structural member of the racecar. The system preferably includes a quick connect apparatus for allowing the driver to easily escape from the head restraint system. The system preferably includes a rotatable connector which allows the driver to rotate his head left and right so that his lateral vision will not be impeded by the head restraint system.

31 Claims, 4 Drawing Sheets

HEAD RESTRAINT SYSTEM FOR RACECAR DRIVERS

This application claims benefit of our pending provisional application Serial No. 60/270,713 entitled "HEAD RESTRAINT SYSTEM FOR RACECAR DRIVERS" filed on Feb. 22, 2001.

BACKGROUND OF THE INVENTION

1. Field of the Invention

The present invention relates generally to head restraint systems, and more particularly, but not by way of limitation, to head restraint systems for use by drivers of racecars, such as those used in the NASCAR racing program.

2. Description of the Prior Art

Fatal neurological damage, i.e. frontal lobe contusions, rupturing of blood vessels, and tearing of nerves, of the brain ensues after many high speed frontal race car collisions. Such fatalities are more prevalent during practice conditions than true racing situations, due to the fact that during competition, much of the car's forward momentum dissipates due to numerous collisions with other drivers before the end of the accident. On the other hand, when dealing with practice situations, and sometimes during actual race conditions, all of the energy of the high speed is transferred between one car and a wall of the racetrack in a full frontal impact. As seen from NHTSA and STAPP Car Conference deceleration studies, approximately 7% of racecar major deceleration crashes were front impact collisions and there is a major need for protection. For everyday drivers, peak decelerations averaged from 40 Gs to 60 Gs. For racecars, this deceleration topped out at over 160 Gs. At peak decelerations of greater than 40 Gs, severe brain injury is likely to ensue, therefore a need for some type of protection of the head from these extreme forces on the brain caused during racecar deceleration exists.

A number of restraint systems are currently available.

One type of restraint system is the use of air bags which can lessen the force on the head after a collision. Air bag technology is typically not usable for racecars, however, because the air bags have been found not to be efficient at the very high speeds of 200 mph or more encountered by racecars. Also, using air bags at high racing speeds would create the risk of abruptly stopping the head in the forward motion and causing severe recoil of the head, resulting in a major skull-brain collision. Also, entrapment of the driver within the vehicle can ensue after the air bag deploys, thus not allowing the driver to escape from a dangerous vehicle which may be on fire.

Another existing restraint system is the use of a five-point harness type seatbelt system which keeps the body in the seat very tightly and protects the upper torso from injury. However, a five-point seatbelt restraint system still leaves the head free and mobile.

Another restraint system known as HANS® (Head And Neck Restraining System) available from Hubbard/Downing Inc., of Atlanta, Ga., anchors the helmet and head with straps. It prevents forward movement in a crash, but it does not absorb the impact; there is still a danger of brain/skull collision. Also, the HANS system impairs the driver's lateral vision.

Another apparatus which bears some superficial similarity to the present invention is that shown in Townsend, U.S. Pat. Appl. Publ. No. 2001/0002087A1. The Townsend system essentially uses a conventional seat belt mounted on in inertially lockable reel type seat belt tensioner. Normal slow head movement and extension of the belt is allowed. A rapid head movement upon impact of the vehicle with an obstacle causes the tensioner to lock the belt in place, and only a slight forward movement beyond the locking point is permitted due to whatever elasticity is inherent in the seat belt material. Total forward movement of the head upon vehicle impact is in the range of 1 to 4 inches. The primary purpose of the Townsend device is to prevent the head from pivoting forward beyond the body, thus reducing neck injury. The shortcoming of the Townsend device is that it does very little to reduce deceleration forces on the head, and even though the head does not crash into the dash or steering wheel, the brain impact within the skull is still severe.

Thus, it is seen that there is a continuing need for a head restraint system for use by racecar drivers which does not impede the driver's comfort and safety during normal use, and which prevents fatal head injury to the driver during a frontal impact.

SUMMARY OF THE INVENTION

A head restraint apparatus for a driver of a vehicle is provided which includes a helmet for receiving the driver's head, an energy dissipating extendable restraining lanyard, a first connector connecting the lanyard to the helmet, and a second connector operably associated with the lanyard for connecting the lanyard to the vehicle, so that upon impact of the vehicle with an obstacle the lanyard extends and dissipates energy to dampen a deceleration shock transmitted to the driver's head. The restraining lanyard has a fixed pre-impact length, and has a threshold tension load beyond which the lanyard extends.

The lanyard may include any one of a number of shock absorbing devices of the type previously developed for use as personal descent restraints for mountain climbers and for workers working at high altitudes who are at risk of falling. These various shock absorber constructions, when utilized with the head restraint apparatus of the present invention, allow the driver's head to begin moving forward once a tension load on the restraining lanyard exceeds a first design level. The head and helmet move forward through a predetermined extension distance, while the shock absorber mechanism dissipates much of the kinetic energy of the forwardly moving head and helmet, so as to reduce the deceleration shock loadings imposed upon the driver's head to a level low enough that severe head injury will not occur.

The present system prevents brain injury because it allows the head to move forward a substantial distance, but at a reduced speed, which prior art devices such as the HANS® device and the Townsend device of U.S. Pat. Appl. Pub. 2001/0002087A1 do not do. Allowing the head to move forward, but at a reduced speed, is the only way to slow down forward movement of the brain relative to the skull. Prior art devices, in contrast, completely prevent the head from moving forward, thereby preventing neck injury but not reducing brain injury.

Preferably, the head restraint system includes a quick release mechanism which allows the driver to quickly escape from the helmet after a crash. The quick release mechanism may be incorporated into the existing five-point quick release mechanism of traditional safety harnesses, so that the helmet restraint system is released at the same time the safety harness is released.

The head restraint system also preferably utilizes a connection assembly between the restraining lanyards and the helmet, which will allow the driver to rotate his head in order to look laterally, so that the driver's lateral vision is not impaired.

Accordingly, it is an object of the present invention to provide a head restraint system for use by racecar drivers which will reduce the deceleration shock forces encountered by the driver's head during a frontal crash.

Another object of the present invention is to reduce driver injury and fatalities in racecar crashes.

Still another object of the present invention is the provision of a head restraint system from which the driver can quickly escape.

Still another object of the present invention is the provision of a head restraint system which allows the driver to have normal lateral head movement during normal usage.

And another object of the present invention is the provision of a head restraint system which is relatively lightweight so as not to induce driver fatigue.

Still another object of the present invention is the provision of a head restraint system which is economical to manufacture.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Analysis of the Forces Imposed upon a Driver's Head During Frontal Impact

Figure 1:
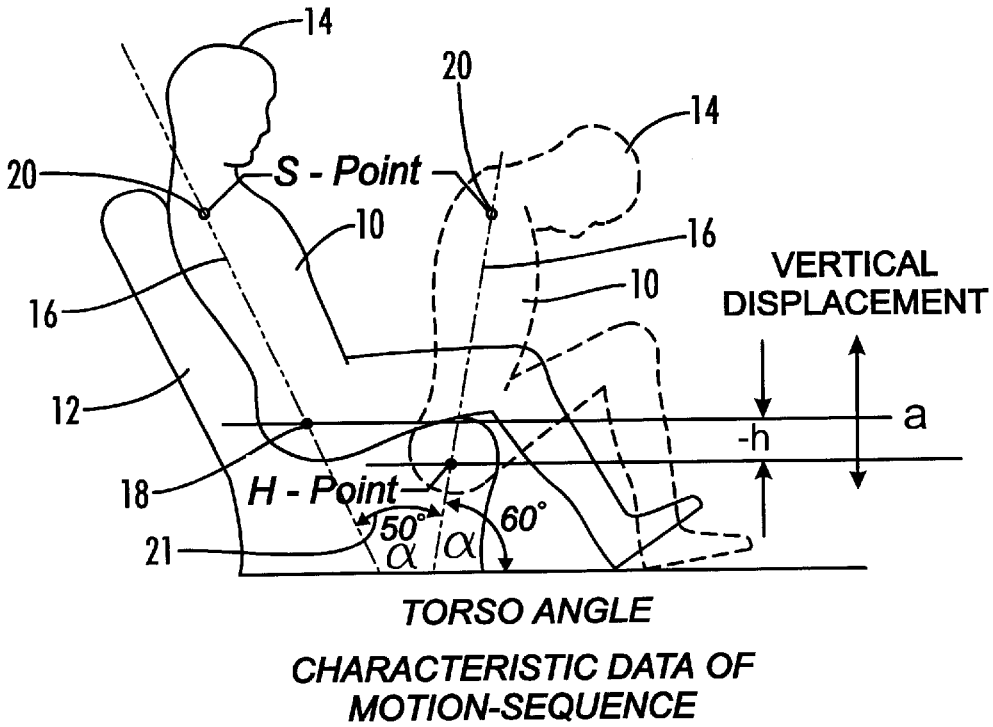
FIG. 1 is a schematic side elevation view illustrating the forward motion of a driver's body and head during a frontal impact collision.

FIG. 1 schematically illustrates a driver 10 sitting in a seat 12 of a racecar. The position of the driver 10 and the driver's head 14 prior to impact is shown in solid lines, and the final position utilizing only a standard five-point harness for restraint, is shown in dotted lines. The driver 10 may also be referred to as an occupant, and the restraining device could of course be used for a passenger occupant as well as the driver occupant.

During frontal impact, two angular force vectors must be considered when determining the forces exerted on the body. First, the torso-head system moves 50° about the hip. This is illustrated in FIG. 1 by referring to an imaginary line 16 drawn between a hip pivot point 18 and a shoulder pivot point 20. The line 16 moves through an angle 22 of 50° as the driver's body moves forward relative to the vehicle after impact. This 50° motion is controlled by the standard five-point restraining harness currently utilized by racecar drivers in the NASCAR system.

Additionally, the driver's head 14 continues to move an additional 60° about the neck during the remainder of the crash. This is illustrated by the downward pivotal motion of the head 14 relative to shoulder pivot point 20 as seen when comparing the solid line and phantom line positions in FIG. 1.

The following calculations show that using only the standard five-point restraining harness, the total deceleration forces applied to the driver's head 14 are approximately 10,818 N. These calculations were performed for maximum racing speeds and maximum force impacts, because our goal is to eliminate the worst case scenario.

Max Parameters

Weight of Head (from anthropometric tables): 8.2% Body Weight=13 lbs or 5.9 kg

Weight of Helmet: 3 lbs. or 1.4 kg

Maximum Speed of Race Car: 230 mph or 103 m/s

Time of Duration of Impact: 0.067 s (from 20th Stapp Car Crash Conference)

$$F = ma \quad \text{(Force of Car)}$$

$$F = (1.4 + 5.9)\ \text{kg} * \frac{(103\ \text{m/s})}{0.067\ \text{s}}$$

$$F = 7.3\ \text{kg} * 1537\ \text{m/s}^2 \Leftarrow \underline{157\ G's}$$

$$F = \underline{11{,}220\ \text{N}}$$

Max Parameters

Range of Movement of Torso: 50 degrees (due to 5 point harness)

Range of Movement of Neck: 60 degrees

Force of Impact of Car: 11,220 N $$Fy = F * \cos\Theta y \ \text{(Force of Torso)}$$

$$F = 11{,}220 \cos(50)$$
$$= 7{,}212\ \text{N}$$

$$Fy = F * \cos\Theta y \ \text{(Force of Head)}$$

$$F = 7{,}212 \cos(60)$$
$$= 3{,}606\ \text{N}$$

$$\text{Total Force on Head} = 7{,}212\ \text{N} + 3{,}606\ \text{N}$$
$$= \underline{10{,}818\ \text{N}}$$

Although conventional helmets have padding to help cushion blows to the driver's head, the effect of such padding is negligible as compared to the extreme force of over 10,000 Newtons demonstrated above.

The Head Restraint System

Figure 2:
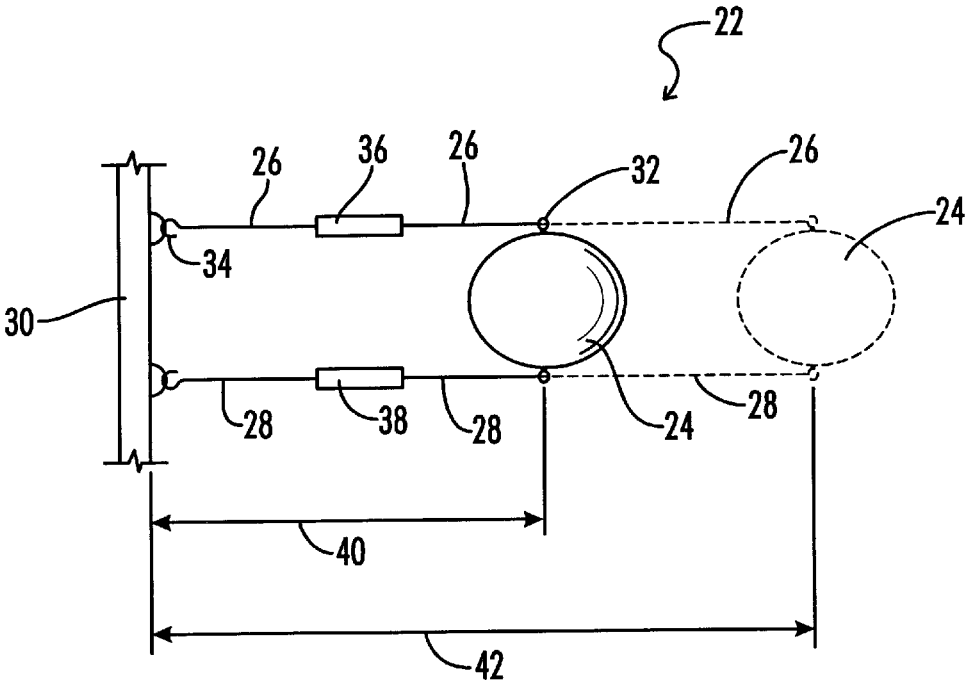
FIG. 2 is a schematic plan view of the head restraint system of the present invention.

FIG. 2 is a schematic plan view of a head restraint system which is generally designated by the numeral 22. The head restraint system 22 includes a helmet 24 for receiving the driver's head 14.

First and second energy dissipating extendable restraining lanyards 26 and 28 are connected between the helmet 12 and a structural member 30 of the roll cage of the racecar vehicle which the driver is driving. In the plan view of FIG. 2, the vehicle is moving from left to right, and the lanyards 26 and 28 extend rearwardly from the helmet 24. The driver is facing to the right in FIG. 2 when the driver looks forward to drive the racecar. Thus, upon frontal impact of the vehicle in a crash, the helmet 24 in FIG. 2 will move to the right thus placing a tension loading upon the restraining lanyards 26 and 28. It will be understood that when the vehicle, of which the roll cage 30 is a part, impacts a wall in a frontal impact, the vehicle will substantially immediately stop. The driver's head 24 continues to move forward as previously illustrated in FIG. 1, thus placing tension loads on the restraining members 26 and 28.

The first restraining lanyard 26 is connected to the helmet 24 by a first connector 32, and is connected to the roll cage 30 by a second connector 34. Various constructions for these connectors, and particularly for the connector 32 connecting the lanyard to the helmet are illustrated and described below.

The restraining lanyards 26 and 28 include shock absorbers 36 and 38, respectively, connected to the lanyards.

The shock absorbers 36 and 38 may be of a number of different constructions, many of which are described below, and they are constructed to allow the lanyards to extend from an initial fixed pre-impact length 40 as illustrated in solid lines in FIG. 2, to a final length 42 as illustrated in dash lines at FIG. 2.

The shock absorbers 36 and 38 are constructed so as to dissipate the kinetic energy of the forwardly moving helmet and driver's head while allowing the lanyard to extend from its initial length 40 to its final length 42, to thus dampen a deceleration shock transmitted to the driver's head 14 upon a frontal impact.

The construction of the lanyards 26 and 28 including their shock absorbers 36 and 38, respectively, is such that the lanyards are non-resilient. That is the lanyards do not cause the driver's head to snap back after it has moved forward to the dashed position shown in FIGS. 1 and 2. This prevents whiplash type injuries to the driver's head. Thus, upon a frontal crash impact, the driver's head is allowed to move forward against the dampened restraining action of the lanyards 26 and 28 and their shock absorbers 36 and 38, thus much more slowly decelerating the driver's head and greatly reducing the shock loads of deceleration imposed upon the driver's head.

The shock absorbers 36 and 38 are constructed so as to define a threshold tension force in the lanyards 26 and 28 required to begin extending the lanyards 26 and 28 from their initial length 40. The distance available for movement of the driver's head before impact with the steering wheel in a NASCAR car is about 24 inches, and preferably the lanyards are designed to use most or all of that distance to dampen the deceleration forces. Preferably the final length 42 exceeds the initial length 40 by at least about 12 inches, more preferably at least about 20 inches, and most preferably about 24 inches.

The lanyards 26 and 28 with their shock absorbers 36 and 38 may be generally described as a restraining means connected to the helmet 24 for dampening a deceleration shock transmitted to the driver's head 14 upon impact of the vehicle with an obstacle.

The shock absorbers 36 and 38 may be generally described as an extendable energy absorbing means connected to the flexible restraining members 26 and 28 for allowing the flexible restraining members 26 and 28 to extend in length thereby allowing the helmet 24 and the driver's head 14 to move forward relative to the vehicle roll cage 30 after a tension load on the flexible restraining members 26 and 28 exceeds a first value, which may also be referred to as a threshold value, and for absorbing kinetic energy from the forwardly moving driver's head 14 as the driver's head 14 moves forward relative to the vehicle roll cage 30.

Construction of the Restraining Lanyards and Shock Absorbers

The restraining lanyards 26 and 28 may be of any construction which will provide the necessary functions of dissipating kinetic energy of the driver's head while allowing the driver's head to move forward a pre-defined distance. The restraining lanyard and shock absorber should be designed so that the tension load on the lanyard must reach a pre-defined threshold level before the lanyard will begin to extend.

A number of suitable shock absorbing restraint technologies have previously been developed in the field of fall protection. For example, mountain climbers and workers who work on high buildings and other structures, and are exposed to the danger of falling, use personal restraint systems which include shock absorbers of the general type just described. Many of those systems which have previously been used for absorbing shocks during falls can be modified for use in the head restraint system of the present invention, and the following are only examples.

One such suitable design for the lanyard and shock absorber system is that available from Elk River, Inc. and sold under the brand name NoPac™ shock absorbing lanyard. The Elk River system absorbs energy by means of a controlled destruction. Two layers of nylon are woven together in a proscribed manner. A force of 450 to 475 lbs is required to initiate tearing of the standard NoPac™ system. The Elk River NoPac™ shock absorbing lanyard system designed for use in fall protection is designed to elongate by 42". That amount of extension is of course too long for use in the head restraint system of the present invention, but a suitable lanyard can be manufactured using the NoPac™ design principles and providing a specified threshold force and a specified energy absorption over a given distance as further described below.

Elk River, Inc. also provides a pack type shock absorber sold under the trade name Flex-Zorber™ in which the shock absorbing material is contained in a pack attached to the lanyard. A similar design utilizing a modified pack having a reduced length of extension could also be utilized in the head restraint system of the present invention.

U.S. Pat. No. 3,444,957 to Ervin, Jr. discloses a shock absorber system for a safety belt having the belt material folded and stitched together. When subjected to loads sufficient to begin rupturing the stitches, the belt will extend in a control manner while absorbing energy as the stitches are ripped apart, thus breaking the impact of a fall. The same technology could be utilized to construct the shock absorbing lanyards for the head restraint system of the present invention. The details of the Ervin, Jr. U.S. Pat. No. 3,444,957 are incorporated herein by reference.

Another suitable design for a shock absorbing lanyard is described in Bell U.S. Pat. No. 5,090,503, the details of which are incorporated herein by reference. At column 1, line 62 through column 2, line 26 of the Bell patent, a system sold by Descent Control, Inc. of Fort Smith, Ark. under the trademark SOFT LANDING is described. The SOFT LANDING lanyard system relies on the frictional threading of a folded length of the lanyard in a serpentine path through a buckle (when ripped fabric is used) or through frictional ferrules (when a rope lanyard is used) to decrease the perceived shock. As tension is applied to the lanyard, the folded portion of the lanyard stored in the area above or along side the buckle or frictional ferrules, passes therethrough. The frictional force imposed on the lanyard material by the buckle or frictional ferrules abates the gravitational shock felt when a person begins to fall. The same approach can be utilized for constructing the restraining lanyards of the present invention.

U.S. Pat. No. 4,446,944 to Forest et al. discloses still another technology for shock absorbing restraining lanyards, and the details of Forest et al. U.S. Pat. No. 4,446,944 are incorporated herein by reference. The Forest et al. shock absorber includes a shock absorber support means having at least a first energy absorbing strap with a reach of predetermined length and made of webbing material which is stretchable when a load applied to it exceeds a predetermined value, but does not rebound when the load is decelerated, the first strap having a first end and a second end and an elastic limit to which it can be stretched. A back up strap is also included which has a longer reach than the first energy absorbing strap and is made of a substantially non-stretchable webbing. The shock absorber may include a plurality of such energy absorbing straps each having a reach of greater length than the first energy absorbing strap and of lesser length than the following strap, so that each energy absorbing strap is of a different length and they are arranged serially so that as the first energy absorbing strap reaches its elastic limit, the next longer strap begins to stretch and absorb additional energy. The energy absorbing straps may be made of unstretched virgin nylon material.

The Forest et al. U.S. Pat. No. 4,446,944 also describes a number of other suitable shock absorbing technologies at column 1, lines 38–53 thereof, all of which are incorporated herein by reference.

U.S. Pat. No. 4,100,996 to Sharp describes an energy absorbing shock absorber for use with a safety lanyard, and the details of the Sharp patent are incorporated herein by reference. The Sharp device pulls a belt through a three bar slide to provide the necessary resistance to decelerate a fall, or in the case of the head restraint system of the present invention to decelerate the forward moving head of the driver.

U.S. Pat. No. 3,804,698 to Kinloch, the details of which are incorporated herein by reference, discloses a shock absorbing strap system having a reusable shock absorbing system.

U.S. Pat. No. 5,598,900 to O'Rourke, the details of which are incorporated herein by reference, discloses a shock absorber system comprising a strip of woven webbing material and a strip of tear ply webbing material. When a pre-determined force is applied to this system, the tear ply webbing separates to dissipate the forces. The O'Rourke U.S. Pat. No. 5,598,900 describes at column 1, lines 44–57 thereof still a number of other systems for absorbing shocks applied to restraint devices or the like, the details of which are incorporated herein by reference.

Connectors

Another important aspect of the head restraint system 22 is the manner of construction of the connectors 32 and 34 by means of which the restraining lanyards are connected to the helmet 24 and to the racecar roll cage 30. Of particular significance is the manner of construction of the connectors 32 between the lanyards and the helmet 24.

Figure 3:
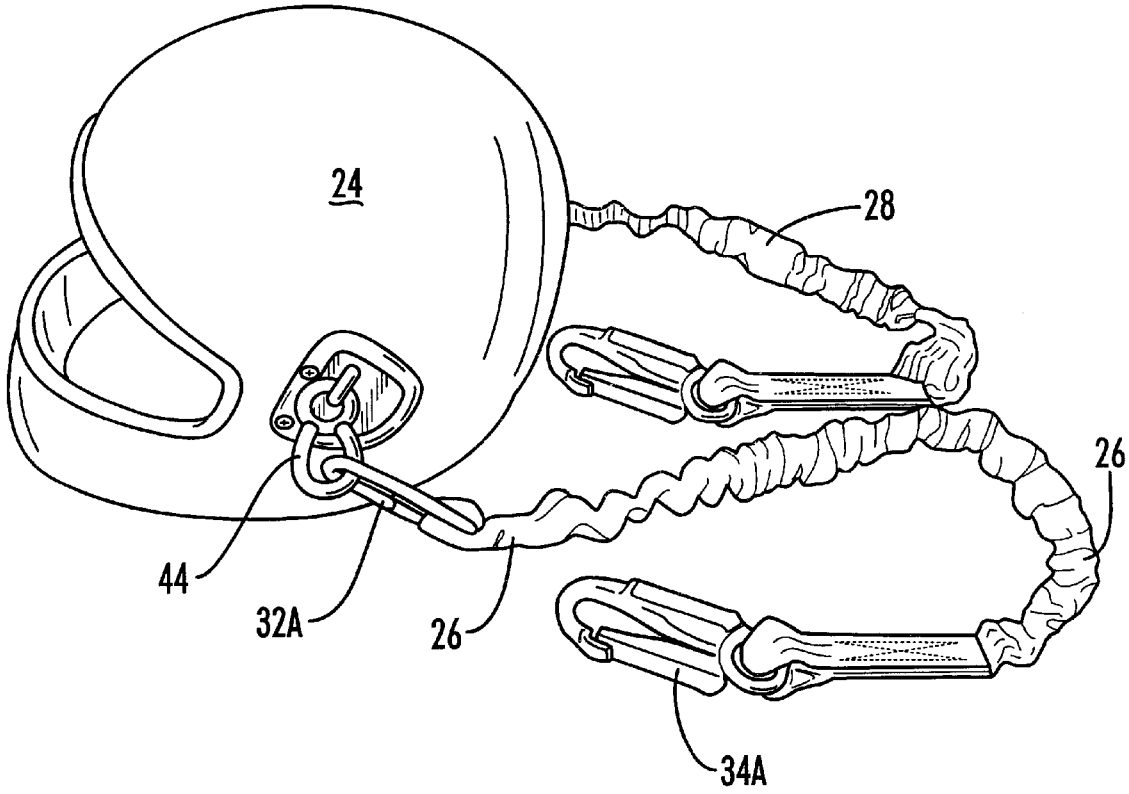
FIG. 3 is a perspective view of a helmet with two restraining lanyards attached thereto with carabiners clipped to steel cable loops attached to the helmet.

Referring now to FIG. 3, the helmet 24 has a steel cable loop 44 attached to each of the opposite sides thereof. The restraining lanyards 26 and 28 are constructed from a length of the Elk River, Inc. NoPac™ shock absorbing lanyard material. First embodiments of the first and second connectors are designated as 32A and 34A, and those connectors are metal clips of the type used by rock climbers and referred to as carabiner clips.

Figure 4:
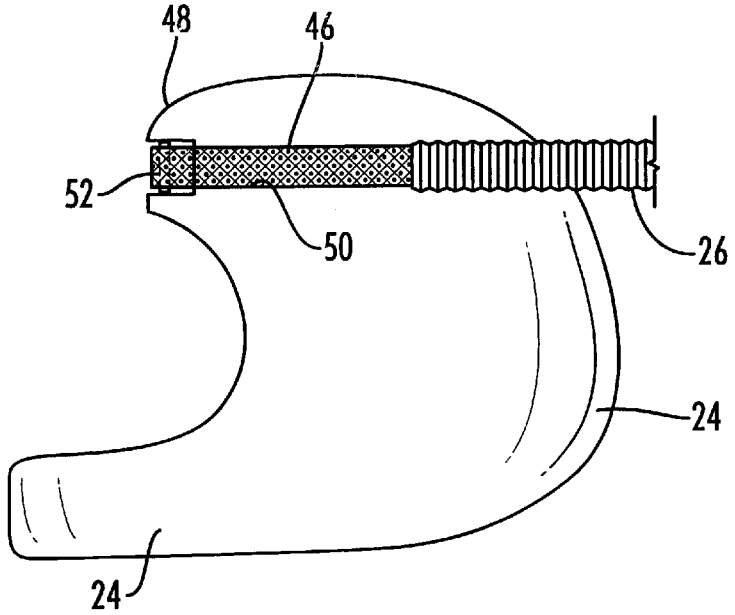
FIG. 4 is a side elevation view of an alternative embodiment of the invention utilizing a continuous lanyard member which is received on rollers in a groove which loops around a forward portion of the helmet.
Figure 5:
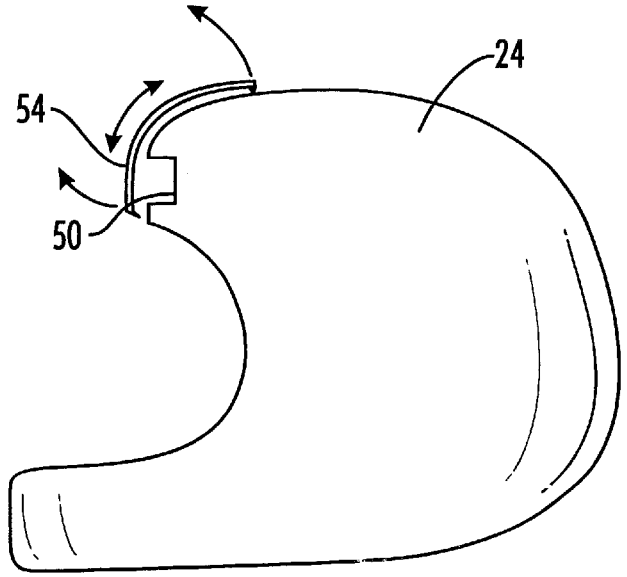
FIG. 5 is a schematic side elevation view of a quick release mechanism for use with the helmet and lanyard connection system of FIG. 4.
Figure 6:
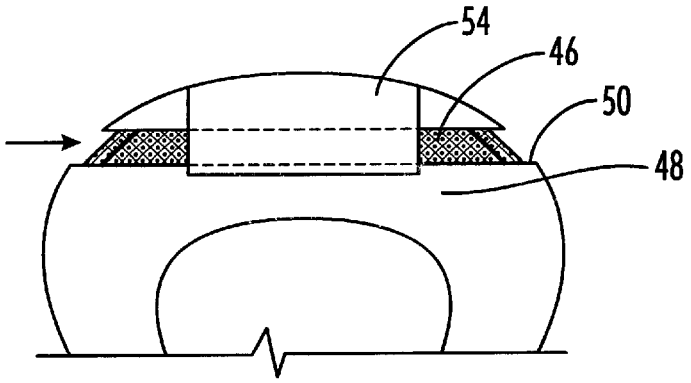
FIG. 6 is a front elevation view of the quick release mechanism of FIG. 5.

FIGS. 4, 5 and 6 illustrate an alternative embodiment of the invention wherein the first and second lanyards 26 and 28 comprise a single continuous lanyard member 46 which wraps around a forward portion 48 of the helmet 24. The forward portion 48 of the helmet 24 has a groove 50 defined therein within which the lanyard member 46 is received. As schematically illustrated in FIG. 4, a plurality of rollers 52 are fitted within the groove 50, and the strap 46 fits over the rollers 52. The rollers 52 may be described as a roller bearing 52 disposed in the groove 50 and engaging the continuous lanyard member 46 to reduce the resistance of sliding motion of the lanyard member 46 in the groove 50 so that the helmet 24 and driver's head 14 can turn to either side, whereby the driver's lateral motion will not be restricted by the action of the restraining lanyards.

FIGS. 5 and 6 schematically illustrate a quick releasable latch 54. The latch 54 is shown in FIGS. 5 and 6 in its latched position in which the lanyard member 46 is confined or trapped within the groove 50 with latch member 54. To provide a quick release of the helmet 24 from the restraining lanyard member 46, the latch member 54 can flip up, flip down or slide back, as determined by a suitable mounting mechanism of the latch member 54 upon the helmet 24. When the latch member 54 is moved so that it no longer traps the lanyard member 46 in the groove 50 it may be described as being in a released position in which the lanyard member 46 may slip out of the groove 50.

The groove 50, roller 52 and continuous lanyard member 46 may be described as a rotatable attachment structure which permits the driver's head 14 to turn sideways.

A Quick Release Mechanism Incorporated with the Five-Point Harness Release

Figure 7:
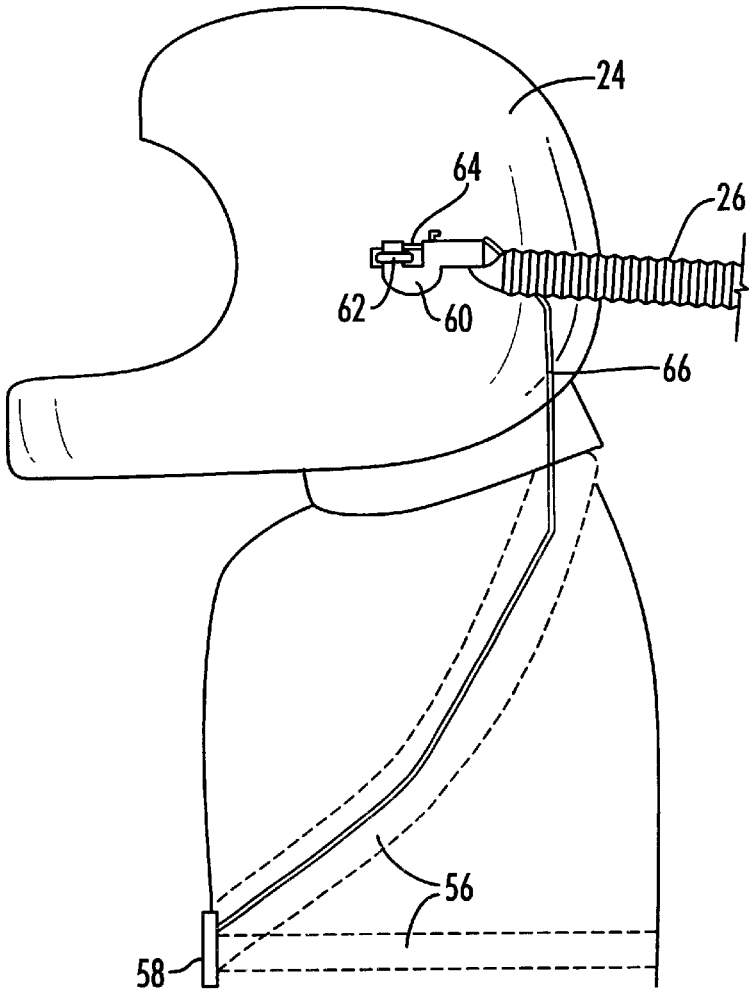
FIG. 7 is a schematic side elevation view of an alternative connection means utilizing a quick release mechanism actuated simultaneously with the quick release buckle of a five-point safety harness.

Referring now to FIG. 7, a quick release system is thereshown which incorporates the buckle release mechanism of the five-point restraining harness conventionally utilized in a NASCAR type racecar.

In FIG. 7, a portion of the five-point restraining harness system is shown and generally designated by the numeral 56. The five-point restraining harness 56 includes five straps which come together at a buckle release mechanism 58.

The lanyard 26 has a hook 60 which is to be received in a loop 62 located on the side of the helmet 24. When the hook 60 is received in the hole 62, it will be trapped therein by a sliding bar mechanism 64. An actuating cable 66 of the type utilized on bicycle brakes or on a motorcycle throttle, will slide the bar 64 to an open position wherein the hook 60 can be removed from the opening 62. The actuating cable 66 is operated when the buckle 58 is pressed to release the five-point restraining harness 56.

A Halo Mounting System

Figure 8:
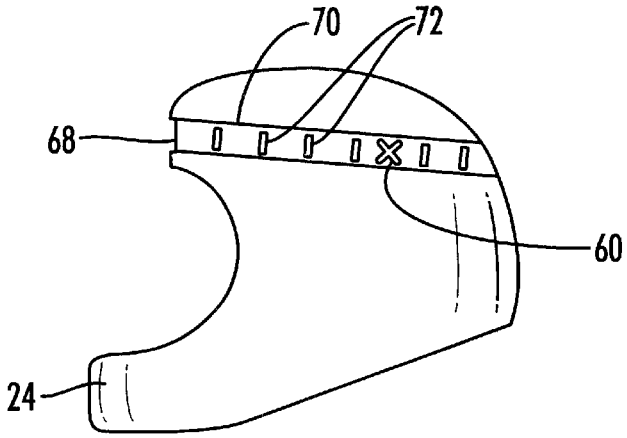
FIG. 8 is a schematic side elevation view of another alternative connection system utilizing a rotatable halo ring received in an annular groove defined in the crown of the helmet.

FIG. 8 illustrates still another alternative embodiment of the invention wherein the helmet 24 comprises a track 68 defined thereon, and a halo ring 70 is sidably disposed in the track 68 so that the driver's head 14 and helmet 24 can be rotated relative to the halo ring 70 to allow the driver to look laterally. A plurality of rollers, such as 72, are disposed between the track 68 and the halo ring 70 to provide relatively frictionless motion between the helmet 24 and the halo ring 70 as the driver rotates his head to look left or right.

The hook mechanisms, such as 60, described with regard to FIG. 7 can be connected to the halo ring 70 and actuated by the cable member 66 in the same manner as previously described, so as to provide a quick release mechanism connecting the first and second lanyards 26 and 28 to the halo ring 70 on opposite sides of the helmet 24.

Calculated Reduction of Deceleration Forces on the Driver's Head

The following is an example of the detailed calculations for the selection of an appropriate restraining lanyard system so as to provide the desired decceleration force reduction on the driver's head.

These calculations are based upon a proposed modification of a shock absorbing lanyard designed in accordance with the technology utilized in the Elk River, Inc. NoPac™ shock absorbing system. The available data for that system indicates that a 220 lb weight arrested from a 6 foot freefall by a lanyard which extends 42 inches results in a maximum arresting force of 875 lbs force. Utilizing this data it will be shown that a system utilizing two parallel lanyards, as disclosed in the present application, using a design similar to the Elk River NoPac™ system, and having a length of 24 inches, would require the lanyards to provide an energy absorption per unit of extension equal to approximately 1.3 times the energy absorption provided by the presently commercialized Elk River, Inc. NoPac™ shock absorbing lanyard.

Utilizing the data provided for the performance of the currently commercialized Elk River NoPac™ shock absorber, the theoretical approach used is to model the lanyard as a linear spring and to set the gravitational potential energy of the 220 lb weight dropping a total of 9.5 feet equal to the elastic potential energy which would be stored in the spring model.

The first set of calculations set forth below calculates the spring constant for the model spring from the energy of the system:

Calculation of the Spring Constant from the Energy of the System $$\Delta Ue + \Delta Ug + \Delta K = 0 \qquad \text{[Law of Conservation Energy]}$$

$$\left(\frac{1}{2}kd^2\right) - mgy + 0 = 0 \qquad [k = 0,\ b/c \text{ intial kinetic energy} = 0 \text{ and final kinetic energy} = 0]$$

$$\left(\frac{1}{2}\right)(\text{k})(1.07\ \text{m})^2 - (100\ \text{kg})(9.8\ \text{m/s}^2)(2.9\ \text{m}) = 0$$

$$k = \frac{(2845)(2)}{(1.07)^2}$$

$$k = 5000\ \text{N/m}$$

The calculations just given represent the spring constant for the model if the lanyard brought the arresting force to zero. If the lanyard was in fact a linear spring bringing the arresting force to zero, it would store or absorb all of the potential energy which was present in the 220 lb weight falling a distance of 9.5 feet. While the lanyard is not in fact a spring, this model is appropriate for the following reason. For a constant rate spring the restoring force of the spring increases linearly. With the lanyard in question the energy absorption with distance extended is linear which correlates to a linear reduction in the remaining arresting force. Thus the linear reduction in arresting force due to energy dissipation by the extendable lanyard is analogous mathematically to the linear storing of potential energy in a spring.

The next series of calculations takes into effect the fact that the Elk River lanyard did not in fact reduce the arresting force to zero, but instead resulted in an arresting force of 875 lbs force. This leads to a corresponding reduction in the calculated "spring constant" for the model analogous to the Elk River lanyard as follows:

Correcting the Elastic Constant by Accounting for the Arresting Force

1) Calculation of the Force Absorbed by the Elk River System $$F = kx$$
$$= (5000\ \text{N/m})(2.9\ \text{m})$$
$$= 14{,}500\ \text{N}$$

2) Correction of this force vector.

The arresting force is the force generated by arresting the test weight. Therefore, this force opposes the above 14,500 N.

$$Fc = 14{,}500\ \text{N} - 3892\ \text{N}$$
$$= 10{,}608\ \text{N}$$

3) Calculation of the Spring Constant after considering the arresting force $$k = Fc/y$$
$$= 10{,}608\ \text{N}/2.9\ \text{m}$$
$$= 3{,}658\ \text{N/m}$$

With the spring constant which has just been calculated for the currently commercially available Elk River NoPac™ shock absorbing lanyard, the force reduction which would be provided by a 24 inch extension of such a lanyard (which 24 inches corresponds to the design extension length for the head restraint system of the present invention) would be as follows:

Force Absorbed by One Lanyard in 24 in [0.6096 m]

$$F = kx$$
$$= (3{,}658)(0.6096)$$
$$= 2{,}223\ \text{N}$$

Note: 24 in is the distance that the head travels upon impact.

Now, the question can be asked as to how many of the 24 inch lengths of Elk River NoPac™ shock absorbing lanyard would be required to reduce the maximum deceleration force encountered by a race car driver to a level below 5,000 N which the medical literature shows to be the level at which serious injury becomes a danger. The following calculations are based upon the previously calculated force exerted on the head and helmet of 10,818 N. It should be noted that even if the entire possible impact force of 11,220 N previously shown were utilized in these calculations, there would be little difference in the outcome.

Force Needed to Initiate Tearing Check

Force Exerted on Head and Helmet: 10,818 N {see previous calculations}

Deployment point when reducing force to 5,000 N, $$\Delta F = 10{,}818\ \text{N} - 5{,}000\ \text{N}$$

$$= 5{,}818\ \text{N}$$

Therefore, we need the force of about 2.6 Elk River Lanyards

Force Needed to Initiate Tearing=450 lbf (×2.6)=5203.5 N

Weight of Helmet+Head=7.3 kg

Maximum Speed of Race Car=230 mph or 103 m/s

Time of Duration of Impact=0.067 s

F=ma 5203.5 N=7.3 kg*a a=712.80 m/s$^2$

Therefore, the system will deploy at v=712.80 m/s$^2$*0.067 s v=47.76 m/s=106.98 mph From a study of brain tolerance during frontal impact positions, which was conducted by the 20th STAPP Car Crash Conference, it was concluded that forces above 10,000 N would result in major damage to the brain. According to that study, it is preferable to reduce forces applied to the brain to under 5,000 N, which is a level at which no significant damage to the brain is expected.

The above calculations show that a system of shock absorbing lanyards equivalent to approximately 2.6 of the commercially available Elk River, Inc. NoPac™ shock absorbing lanyard, 24 inches long, would reduce the maximum deceleration force experienced by the driver to a level of approximately 5,000 N, and also show that such a system would deploy at any impact speed in excess of approximately 107 mph which is well below that typically encountered in a race car collision. Thus, in a system utilizing two parallel lanyards, one connected to each side of the helmet as disclosed herein, each of the lanyards would be constructed to have an energy dissipation per unit extension of about 1.3 times that of the currently commercially available Elk River, Inc. NoPac™ shock absorber, a modification which is easily within the capabilities of available technology.

The present system provides an economically constructed head restraint system. The maximum deceleration forces imposed upon the driver's head and brain are greatly reduced to a level below that at which severe head injury would be expected. The system provides an easy and safe escape mechanism. The system allows sufficient lateral visual range of motion so that the driver's normal head movement will not be impaired. The system is constructed of lightweight materials so that no significant additional fatigue will be caused to the driver. The system is compatible with professional racecar helmet standards.

Thus, it is seen that the apparatus and methods of the present invention s readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A head restraint apparatus for an occupant of a vehicle, comprising:

a helmet for receiving the occupant's head;

at least one energy dissipating, extendable restraining lanyard having a fixed pre-impact length, and having a threshold tension load beyond which the lanyard extends a first connector connecting the lanyard to the helmet; and a second connector operably associated with the lanyard for connecting the lanyard to the vehicle, so that upon impact of the vehicle with an obstacle the lanyard extends and dissipates energy to dampen a deceleration shock transmitted to the occupant's head.

2. The apparatus of claim 1, wherein:

the lanyard is a non-resilient lanyard.

3. The apparatus of claim 1, wherein the lanyard is extendable at least 12 inches.

4. The apparatus of claim 1, wherein the lanyard is extendable at least about 20 inches.

5. The apparatus of claim 1, wherein the lanyard is constructed to absorb energy by controlled destruction of the lanyard as the lanyard extends.

6. The apparatus of claim 1, wherein:

the first connector includes a quick releasing latch releasably connecting the lanyard to the helmet.

7. The apparatus of claim 1, wherein:

the first connector includes a rotatable attachment structure which permits the occupant's head to rotate laterally.

8. The apparatus of claim 1, wherein:

the lanyard is a first lanyard; and the apparatus further includes a second lanyard, the first and second lanyards being connected to the helmet, on opposite sides of the helmet.

9. The apparatus of claim 8, wherein:

the first and second lanyards comprise a single continuous lanyard member.

10. The apparatus of claim 9, wherein:

the single continuous lanyard member wraps around a forward portion of the helmet.

11. The apparatus of claim 10, wherein:

the forward portion of the helmet has a groove defined therein within which the lanyard member is received.

12. The apparatus of claim 11, further comprising:

a roller bearing disposed in the groove and engaging the lanyard member to reduce resistance to sliding motion of the lanyard member in the groove so that the occupant's head can rotate laterally.

13. The apparatus of claim 11, wherein the first connector comprises:

a quick releasable latch having a latched position in which the lanyard member is confined in the groove, and having a released position in which the lanyard member may slip out of the groove.

14. The apparatus of claim 1, further comprising:

a track defined on the helmet;

a halo ring rotatably disposed in the track of the helmet, so that the occupant's head and the helmet can be rotated relative to the halo ring to allow the occupant's head to rotate laterally; and the lanyard being connected to the halo ring.

15. The apparatus of claim 14, further comprising:

a quick release mechanism connecting the lanyard to the halo ring.

16. The apparatus of claim 6, wherein:

the quick releasing latch includes an actuating cable adapted to be connected to a safety harness release of the vehicle, so that the quick releasing latch releases simultaneously with the safety harness release.

17. A shock absorbing apparatus, comprising:

a helmet;

at least one extendable lanyard connected to the helmet and having an initial length and a final length greater than the initial length; and a shock absorber connected to the lanyard, and so arranged and constructed as to be operative as the lanyard extends from its initial length to its final length.

18. The apparatus of claim 17, wherein the shock absorber is non-resilient.

19. The apparatus of claim 17, wherein the shock absorber defines a threshold tension force required to begin extending the lanyard from the lanyard's initial length.

20. The apparatus of claim 17, wherein the final length exceeds the initial length by a distance sufficient to allow the occupant's head to pivot forward beyond the occupant's body by an angle of at least about 60°.

21. The apparatus of claim 17, wherein the final length exceeds the initial length by at least 12 inches.

22. The apparatus of claim 17, wherein the final length exceeds the initial length by at least 20 inches.

23. The apparatus of claim 17, further comprising:

a rotatable connector between the helmet and the lanyard so that an occupant's head may rotate laterally.

24. The apparatus of claim 17, further comprising:

a quick release mechanism connecting the lanyard and the helmet.

25. A head restraint apparatus for an occupant of a vehicle, comprising:

a helmet for receiving the occupant's head;

at least one flexible restraining member extending rearward from the helmet and connected to the vehicle; and an extendible energy absorbing means, connected to the flexible restraining member, for allowing the flexible restraining member to extend in length thereby allowing the helmet and the occupant's head to move forward relative to the vehicle after a tension load on the flexible restraining member exceeds a first value, and for absorbing kinetic energy from the forwardly moving occupant's head as the occupant's head moves forward relative to the vehicle.

26. A method of reducing head injuries to an occupant of a vehicle during a crash, comprising:

(a) providing a head restraint system including a helmet and at least one flexible restraining member connecting the helmet to the vehicle;

(b) restraining the helmet against forward movement until forward forces on the helmet exceed a first level; and (c) then extending the restraining member while dissipating energy via the restraining member to dampen forward motion of the occupant's head and the helmet.

27. The method of claim 26, further comprising:

allowing lateral motion of the helmet and the occupant's head prior to the crash, so that the head restraint system does not impede the occupant's lateral vision.

28. The method of claim 26, further comprising:

quickly releasing the head restraint system with a single releasing action so that the occupant can escape the head restraint system.

29. The method of claim 26, wherein:

in step (c) deceleration forces imposed upon the occupant's head are no greater than 5,000 N.

30. The method of claim 26, wherein step (c) comprises extending the restraining member at least 12 inches.

31. The method of claim 26, wherein step (c) comprises extending the restraining member at least 20 inches.

* * * * *